United States Patent [19]

Grantham

[11] Patent Number: 4,668,435

[45] Date of Patent: May 26, 1987

[54] THERMAL CONVERSION OF WASTES

[75] Inventor: LeRoy F. Grantham, Calabasas, Calif.

[73] Assignee: Rockwell International Corporation, El Segundo, Calif.

[21] Appl. No.: 591,778

[22] Filed: Mar. 20, 1984

Related U.S. Application Data

[62] Division of Ser. No. 451,516, Dec. 20, 1982, Pat. No. 4,499,833.

[51] Int. Cl.[4] ..... G21F 9/14

[52] U.S. Cl. ..... 252/632; 252/631; 252/626

[58] Field of Search ..... 252/631, 632, 626; 110/237, 238, 342, 343, 346, 348; 159/4.01, 4.02, 48.1, DIG. 12; 34/10, 57 R

[56] References Cited

U.S. PATENT DOCUMENTS

| | | | |
|---|---|---|---|
| 2,889,874 | 6/1959 | Garevin | 159/48 |
| 3,008,904 | 11/1961 | Johnson et al. | 252/632 X |
| 3,101,258 | 8/1963 | Johnson | 252/632 X |
| 3,738,289 | 6/1973 | Hanway, Jr. | 110/237 |
| 4,053,432 | 10/1977 | Tiepel et al. | 252/632 |
| 4,425,856 | 1/1984 | Szilagyi | 110/238 X |

*Primary Examiner*—John F. Terapane
*Assistant Examiner*—Virginia B. Caress
*Attorney, Agent, or Firm*—H. Fredrick Hamann; Harry B. Field; Clark E. DeLarvin

[57] ABSTRACT

Wastes, in the form of liquids, solids and slurries, are converted to a mixture of a gas and an inorganic ash by introducing the waste as a finely atomized spray into a zone heated by means of a hot gas. Contact of the spray particles with the hot gas results in drying the waste and calcining and combusting the dried waste. The process is particularly useful with wastes containing hazardous materials such as radioactive substances.

7 Claims, 3 Drawing Figures

THERMAL CONVERSION OF WASTES

This is a division of application Ser. No. 451,516 filed Dec. 20, 1982, now U.S. Pat. No. 4,499,833.

BACKGROUND OF THE INVENTION

1. Field of the Invention

This invention relates to waste management and more particularly to the thermal conversion of wastes. In one of its more particular aspects this invention relates to a process for converting wastes contaminated with hazardous materials such as radioactive or other toxic substances into readily disposable materials. In another of its more particular aspects, this invention relates to a process for reducing the volume of wastes.

2. Prior Art

Waste management frequently involves the necessity of disposing of large volumes of materials, some of which may be contaminated with hazardous substances. In the processing of radioactive materials in nuclear power plants, for example, large amounts of liquid and solid wastes contaminated with radioactive materials, known as low-level wastes, are produced. Disposal of waste materials of this type cannot be readily accomplished by conventional waste disposal techniques. Because of the relatively long half-lives of certain radioactive elements, the most widely used disposal techniques are storage, solidification, and burial. The expense of so disposing of large volumes of low-level radioactive wastes, however, is constantly rising and approaching prohibitive levels.

Attempts have been made to reduce the volume of radioactive and other toxic wastes which must be stored or buried. Incineration of such wastes is not completely satisfactory because the wastes are only partially destroyed by incineration and noxious gases may be produced. Certain solid waste materials, such as ion exchange resins, for example, are particularly difficult to destroy. Wastes containing a large proportion of sodium nitrate, on the other hand, are difficult to calcine.

Various methods for disposing of particular kinds of wastes have been disclosed. U.S. Pat. No. 2,029,725 discloses a process for burning sludge which utilizes a rotating wheel to break up the sludge and direct sludge particles into a furnace fired with an oil flame. This process is designed primarily to dispose of sludge by burning and is not readily applicable to other forms of waste, the burning of which may result in undesired byproducts.

U.S. Pat. No. 2,889,874 describes a process for thermal treatment of finely divided substances which utilizes a radiantly heated chamber to concentrate or dry materials which are sprayed into the chamber. This process was particularly designed for thermal separations, but may also be used for some thermal decompositions, such as the production of carbon from carbonaceous materials. The process is not readily adaptable, however, to the complete combustion of wastes.

U.S. Pat. No. 3,101,258 describes a heated-wall spray calcination reactor useful for disposing of nuclear reactor waste solutions in which deposition on the walls of the reactor is suppressed by supplying gas from the lower zone of the reactor to the region of a nozzle jet by means of an annular passage extending substantially the length of the reactor. In a spray calcination reactor of the heated-wall type, the temperature gradient from the outside of the reactor inward results in uneven heating.

U.S. Pat. No. 3,738,289 discloses a process in which waste sludge from which water has been largely removed is sprayed downward into an upward flowing gas while maintaining a sludge-incinerating temperature. The upward flow of gases is sufficient to reverse the movement of sludge particles so that ash is separated overhead. While this patent teaches a method for burning sludges in a more efficient manner than using a conventional incinerator, the need for maintaining an upward gas flow requires careful adjustment of the relative flows of air, sludge, and gas. In addition, some volatile solids are carried over with the ash.

U.S. Pat. No. 3,892,190 discloses a process for the chemical oxidation of noxious or undesired gaseous, liquid, and solid wastes which utilizes a cylindrical oxidation vessel in which air is passed countercurrently to the direction of flow of combustion gases and wherein the vessel walls are cooled by excess air. The process of this invention additionally requires the use of a water scrubber and exhausting means to reduce the pollution levels of the product gases and is thus relatively complicated.

U.S. Pat. No. 3,903,813 discloses a method of injecting liquid sludges into a combustion chamber to produoe a sludge spray, and rapidly heating such sludge spray to a temperature sufficient to cause combustion of the sludge by a burner flame disposed slightly above and at a diverging angle to the point at which the sludge is injected into the chamber. Although this patent discloses a convenient method for disposing of liquid sludges, it is not particularly adaptable for use with solids in the form of discrete particles which cannot be broken down during spraying.

U.S. Pat. No. 3,912,577 discloses a process for the treatment of liquid wastes containing a mixture of organic and inorganic substances which includes the steps of concentrating the liquid waste in an evaporator, spraying the concentrated liquid waste into a combustion furnace using steam or compressed air as the atomizing source for spraying, contacting the ash produced in the combustion with water for dissolution of the dried material, and recycling a portion of the combustion gases to the evaporator to utilize the heat contained in the combustion gases by indirect heat exchange with the liquid waste. The combustion occurs at a temperature above the fusion temperature of the ash produced in the combustion. The process disclosed in this patent requires a multiplicity of steps and results in the production of an aqueous solution of the soluble materials present in the ash. Where a solid product is required, additional steps are necessary.

U.S. Pat. No. 3,922,974 discloses a hot air-fired furnace for incinerating radioactive wastes. The apparatus includes special feeding locks and glove boxes for isolating the radioactive components of the wastes and a filter which includes an array of filter candles in which secondary combustion occurs. This apparatus is highly specialized and complex.

U.S. Pat. No. 3,954,381 describes a process for incinerating an aqueous solution containing nitro compounds in which the solution is first concentrated and the concentrated solution then incinerated. Hot combustion gases from the incineration chamber are utilized to evaporate water from the solution. The process requires a number of steps including use of a scrubbing tower to purify off-gases from the incineration prior to release to the atmosphere.

U.S. Pat. No. 4,094,625 describes a method and device for evaporation and thermal oxidation of liquid effluents discharged from industrial plants. In the method of the invention, a fuel in gaseous or liquid form is introduced into a chamber, mixed with an oxidizing gas such as air, and ignited within an enclosed space which is separate from a space occupied by a jet of effluents which are atomized into the chamber at the same time. This method and the device utilized for accomplishing the method prevent the extinguishing of the flame resulting from ignition of the fuel-oxidizing gas mixture. However, while the method is adaptable to liquid and solid effluents, it is not particularly adaptable for use with effluents in the form of slurries, since the method requires that liquids and solids be introduced through separate nozzles.

U.S. Pat. No. 4,145,396 describes a process for reducing the volume of organic waste material contaminated with a least one volatile compound-forming radioactive element selected from the group consisting of strontium, cesium, iodine, and ruthenium. The selected element is fixed in an inert salt by introducing the organic waste and a source of oxygen into a molten salt bath maintained at an elevated temperature to produce solid and gaseous reaction products. The molten salt bath comprises one or more alkali metal carbonates and may optionally include from 1 to about 25 wt % of an alkali metal sulfate. Although effective in reducing the volume of organic wastes, the separation of the radioactive materials from the nonradioactive components of the molten salt bath requires a number of additional cumbersome and time-consuming steps.

U.S. Pat. No. 4,194,454 discloses a method for incinerating sludges which utilizes a number of burners located in the bottom of a combustion zone into which is admitted sludge pulverized by means of compressed air. While the process of this invention is useful for incinerating solid sludges, it is not generally adaptable to other forms of waste materials.

U.S. Pat. No. 4,201,676 describes a method for the thermal treatment of colliery tailings, a material which contains water and combustible and incombustible components, by introducing the material in a slurry form having a solids content between 45% and 65% into a fluidized bed whereby combustible components are burned, at least in part, and the water content is volatilized substantially instantaneously. The fluidized bed is maintained at a temperature below that at which the solid components sinter. This process is effective for heat treating colliery tailings but is not particularly adaptable for use with other forms of waste materials. In aodition, this process displays the disadvantages common to any fluidized bed technique including the need for a constant fluidizing gas supply.

U.S. Pat. No. 4,262,611 discloses a method and apparatus for incinerating wastes which are at least partly solid in which pyrolyisis and combustion are accomplished in separate zones, and the gases from the combustion are recirculated to the pyrolysis zone. Although this method provides a means of incinerating wastes which are at least partly solid, the amount of solids and gases fed to the combustion zone must be carefully controlled in order to assure that the pyrolysis and combustion reduce the volume of the waste fed to the incinerator to the desired extent.

It would be desirable to provide a more versatile process which is capable of reducing the volume of liquid wastes, solid wastes and slurries, particularly wastes which are difficult to dispose of by conventional means.

OBJECTS OF THE INVENTION

It is accordingly an object of this invention to provide a process which is capable of destroying a wide variety of waste materials.

Another object of this invention is to provide such a process which is safe, efficient, and inexpensive.

Another object of this invention is to provide a means for treating wastes in a manner such that the ash remaining after treatment is of the minimum volume possible.

Another object of this invention is to provide a process for converting a liquid waste into a solid material of reduced volume which is more easily disposed of than the liquid waste.

Another object of this invention is to provide a process which is adaptable to liquid wastes, solid wastes and slurries.

Another object of this invention is to provide a process which is capable of destroying hazardous wastes.

Another object of this invention is to provide a process which is capable of reducing the volume of low-level radioactive wastes.

Another object of this invention is to provide a process which is capable of destroying organic waste materials and calcining inorganic waste materials.

Another object of this invention is to provide a process which is capable of destroying ion exchange resins and filter aids contaminated with hazardous materials such as radioactive substances.

Another object of this invention is to provide a process which is capable of calcining sodium nitrate-containing wastes.

Another object of this invention is to provide a process which is capable of destroying various complexing materials contaminated with hazardous materials such as radioactive substances.

Other objects and advantages of this invention will become apparent in the course of the following detailed description.

SUMMARY OF THE INVENTION

In general, the present invention provides a process for the thermal conversion of a waste material which comprises introducing the waste material in the form of a finely atomized spray into a zone heated by means of a hot gas contained within said zone to a temperature sufficient to convert the waste material, by contact with the hot gas, into a mixture of products comprising a gas and an inorganic ash, removing the mixture of products from the heated zone, and separating the ash from the mixture of products, the ratio of the volume of the waste material to the volume of the ash being in the range of about 7:1 to 70:1, depending upon the content of the waste which is noncombustible, principally the noncombustible cation content of the waste material. For example, where the noncombustible cation content of the waste is about 8%, and the density of the waste is 1 g/cc, the process of the present invention effects a volume reduction which will result in a waste-to-ash ratio of about 12:1 if the resultant ash density is 1 g/cc. However, if the original waste density is about 0.17 g/cc (10 lb/cu ft) as in the case of typical low level trash generated at a nuclear power plant, the volume reduction would be approximately 70:1.

The gaseous product, after suitable purification to remove particulates; oxides of nitrogen, if present; oxides of sulfur, if present; and any other noxious gases, is sufficiently nonpolluting to be released to the atmosphere.

The ash, which is greatly reduced in volume compared to the volume of the waste material, is readily disposable by conventional means.

Many hazardous materials with which the waste being treated may be contaminated are destroyed by the thermal conversion treatment of this invention. Other hazardous materials are partially destroyed leaving hazardous solid residues. Hazardous residues remaining after the thermal conversion treatment are found in the ash and can be disposed of by storage or burial. Low-level radioactive wastes, for example, are converted to gases and a radioactive ash which can be incorporated into a solid matrix such as a glass, ceramic, polymeric or concrete matrix for safe storage or burial. High-level radioactive wastes may be calcined to reduce the volume thereof prior to solidification and storage.

BRIEF DESCRIPTION OF THE DRAWING

FIG. 3 is a graph relating the combustion efficiency for various organic wastes to the outlet temperature of the zone within which the process of the present invention is carried out.

DESCRIPTION OF THE PREFERRED EMBODIMENTS

Figure 1:
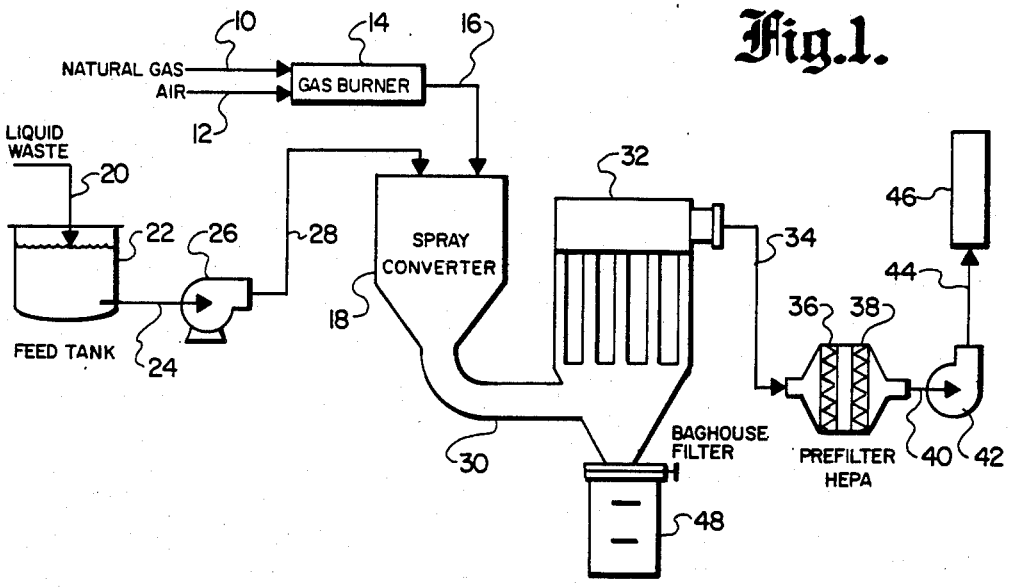
FIG. 1 is a schematic flow diagram illustrating an embodiment of the process of the present invention.

The process of the present invention converts wastes, for example, wastes contaminated with hazardous materials, such as radioactive and other toxic substances, into solids and gases. The solids are in the form of an inorganic ash which can be readily disposed of by conventional means. The gases, after suitable purification, can be released to the atmosphere.

The process accomplishes the thermal conversion and commensurate reduction in volume of combustible or calcinable waste materials by contacting such waste materials, in the form of a finely atomized spray, with a hot gas. In general, the hot gas, which contains an excess of an oxidizing gas, is air heated by means of a suitable burner. Any combustible gas, such as natural gas; liquid, such as fuel oil; or solid fuel, such as coal or coke; may be used in such a burner. Natural gas is preferred as the fuel, in which case the hot gas which contacts the waste materials consists of a mixture of oxygen, nitrogen and the oxidation products of natural gas. The heated air mixture, which may be enriched with oxygen or diluted with steam, if desired, is introduced into a suitable calcining or combustion zone, the temperature of which is maintained in the range of about 500° to 1000° C., preferably about 600° to 850° C. It is important that the temperature throughout the reaction zone be above about 600° C. for complete destruction of difficult-to-burn organic materials. Maximum volume reduction is realized by treating the waste in a manner such that combustion thereof is about 97% or more complete. Temperatures above about 600° C., measured at the outlet to the calcining or combustion zone are necessary to achieve this result. At outlet temperatures below about 500° C. combustion is found to be about 85% or less complete for difficult to burn materials such as wet resins or organic filter aids.

FIG. 3 shows the combustion efficiencies for various organic wastes as a function of the outlet temperature of the calcining or combustion zone.

A suitable apparatus in which to carry out the process of the invention is a heated gas spray dryer modified to function as a heated gas spray converter. For this purpose, the walls of the spray dryer are insulated and equipped with wall heaters to insure that the temperature in the thermal conversion zone does not fall below a certain desired level for effective calcination or combustion, as desired. Uniform heating throughout the thermal conversion zone is important in assuring that the thermal conversion of waste materials is complete.

Depending upon the particular type of waste material being treated, that is, whether the waste is in the form of a liquid, slurry, wet solid, or a dry solid, the thermal conversion accomplished by the process of the present invention may include drying, combustion, calcination, or mixtures of two or more of these effects.

A liquid waste containing a high concentration of a substance which, in the dry state is a heat-stable, high-melting material, is converted first of all to a solid and then to the product of calcination of the resulting solid. For example, $NaNO_3$ solution is converted to a dry ash containing $Na_2O$ and a gaseous product containing nitrogen gas and possibly oxides of nitrogen.

Solid organic wastes and other combustibles undergo complete combustion to produce a gas containing principally $CO_2$ and $H_2O$ and possibly other gases containing nitrogen or sulfur if these elements are present in the waste.

Slurries of organic solids in aqueous solutions such as ion exchange resin slurries are converted to $CO_2$ and $H_2O$ gas and possibly nitrogen-containing gases, or sulfur-containing gases, and an inorganic ash, which contains the oxidation products of the materials with which the ion exchange resins were contaminated. In the case of ion exchange resins used in nuclear plants, cation exchange resins become contaminated with radioactive metal ions and anion exchange resins become contaminated with radioactive anions such as iodide ions. The thermal conversion process of this invention, in general, converts such ion exchange resins to a mixture of non-radioactive gases, the composition of which depends upon the type of ion exchange resin used, and radioactive inorganic ashes. Cation exchange resins, contaminated with radioactive metal ions, are converted to $CO_2$ and $H_2O$ and an inorganic ash containing a mixture of metal oxides contaminated with radioactive metal oxides. Where sulfur is present in the cation exchange resin, the gaseous product also contains $SO_2$ and the inorganic ash also contains metal sulfates contaminated with radioactive metal sulfates.

In the case of anion exchange resins contaminated with radioactive iodide ions, sufficient alkali metal ions may be added, for example as $Na_2CO_3$, so that the inorganic ash contains radioactive metal iodides. The gaseous product contains $CO_2$, $H_2O$ and oxides of nitrogen.

Where the ion exchange resin is a strong cation exchange resin containing sulfonic acid groups, $SO_2$ may be present in the off-gases. Various methods of absorbing $SO_2$ from flue gases are known. Any of the conventional methods for $SO_2$ removal such as treating the gas with various alkaline materials may be used. A method of eliminating $SO_2$ from the off-gases, however, which is preferred because of its convenience, is to add an alkaline material to the aqueous slurry of ion exchange resin. An aqueous solution or slurry of an alkali metal or alkaline earth metal hydroxide or carbonate is especially useful for this purpose. Other alkaline materials may be used, if desired.

Adding the alkali to the ion exchange slurry in approximately equal parts has been found effective. A ratio by weight of alkali to ion exchange resin of about 1:10 to 10:1 may be used. $SO_2$ absorptions of about 90% to 98% have been realized in this way.

The problem of nitrogen oxides in the off-gases produced in the combustion of strong anion exchange resins, which contain quaternary ammonium groups, can be similarly dealt with. However, in this case, it is preferred to introduce a gaseous reactant, such as $NH_3$, downstream of the spray converter to reduce $NO_x$ to $N_2$. Amines such as $CH_3NH_2$ and $(CH_3)_2NH$ can similarly be used. The ratio by weight of $NH_3$ or amine to ion exchange resin may be in the range of about 1:10 to 10:1.

Although it is usually possible to realize conversions of ion exchange resins of about 90% to 99% or higher, in some instances, particularly where bead cation exchange resins are burned at lower than 600° C. outlet temperatures, substantially lower conversions may be obtained.

Where such lower conversions are encountered, it is possible to recycle the partially converted ion exchange resin for a second pass through the heated gas spray converter thereby achieving greatly improved conversions. For example, where an ion exchange resin has been converted to the extent of 75% in the first pass through the heated gas spray converter, a second pass results in substantially complete conversion. For this purpose, during the second pass outlet temperatures of about 400° to 800° C. are utilized, with temperatures above about 600° C. being preferred.

Many other forms of waste may be treated in accordance with the process of this invention. In addition to the specific forms already mentioned, the present process can be used to treat solid inorganic wastes, nonaqueous liquid wastes, nonaqueous slurries, and various mixed wastes. All wastes are susceptible to conversion as described above except for those wastes which are noncombustible under the conditions of the process such as solid metal parts, and inorganic oxides such as cements, ceramics and glasses.

As pointed out above, the products of the process of the present invention are a gas and a solid. The solid is produced in a quantity which represents a substantial volume reduction over the waste being treated. Normally, a ratio by volume of waste to ash on the order of at least about 7:1, sometimes as high as about 70:1, is obtained. In the case of ion exchange resins, the ratio is generally about 20:1 or more.

Further processing depends upon the composition of the off-gas and the ash. Where the off-gas contains sulfur oxides or nitrogen oxides, it is desirable to absorb or otherwise eliminate most of these noxious gases prior to release of a gas to the atmosphere. Any of the conventional methods known to the art can be used for this purpose. In addition, the spray converter feed or the gas downstream of the spray converter can be treated as described above.

The solid ash product can be disposed of in accordance with methods well known to the art such as storage, burial or, in the case of hazardous materials such as radioactive ash, incorporation into a glass, ceramic, polymeric or concrete matrix prior to storage or burial.

Referring now to FIG. 1, which illustrates the calcination of a liquid waste, natural gas and air are introduced into a gas burner 14 via conduits 10 and 12, respectively. Heated air from gas burner 14 is introduced into a heated gas spray converter 18 via a conduit 16. Liquid waste is introduced into a feed tank 22 via a conduit 20 and metered via a conduit 24, a metering pump 26, and a conduit 28 to heated gas spray converter 18. At the bottom of heated gas spray converter 18 the solid and gaseous products are removed via a conduit 30 to a baghouse filter 32, and the filtered gases are removed via a conduit 34 to a prefilter 36 and a HEPA filter 38. After fine filtering, the purified gas is conducted to a plant stack 46 via a conduit 40, a fan 42, and a conduit 44. Solid product from baghouse filter 32 is collected in a closed container 48.

Figure 2:
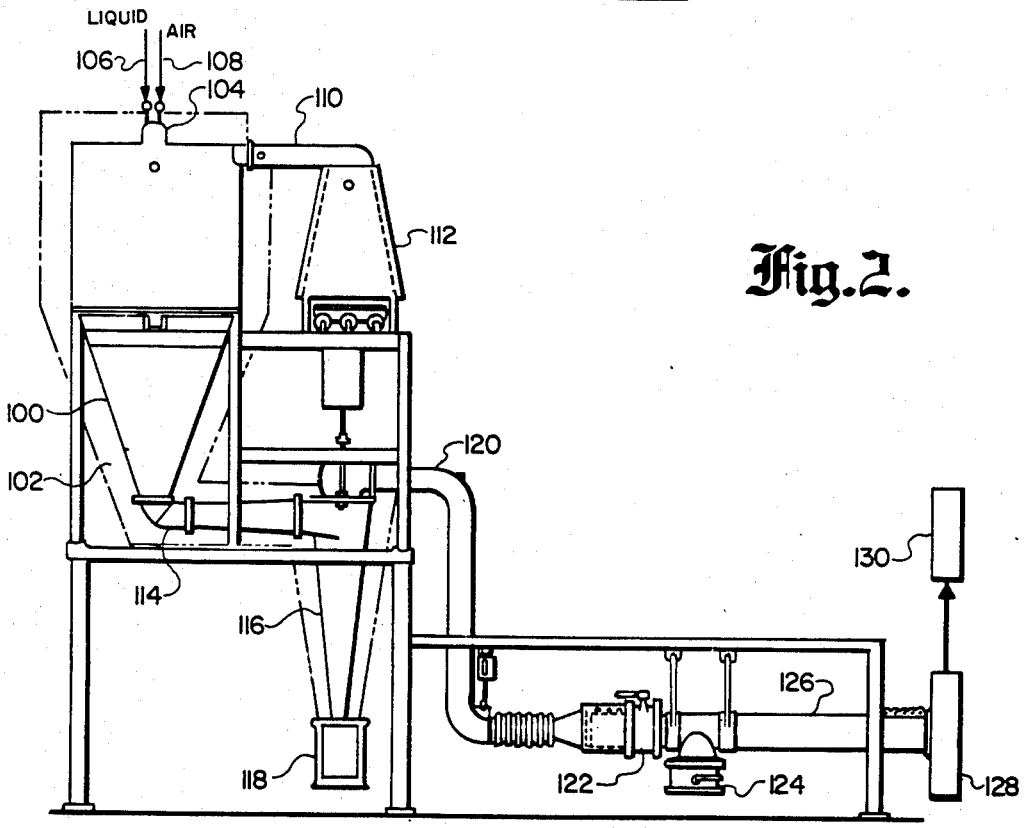
FIG. 2 is a schematic diagram, partly in cross section, of one embodiment of apparatus which can be used in carrying out the process of the present invention.
Figure 1:
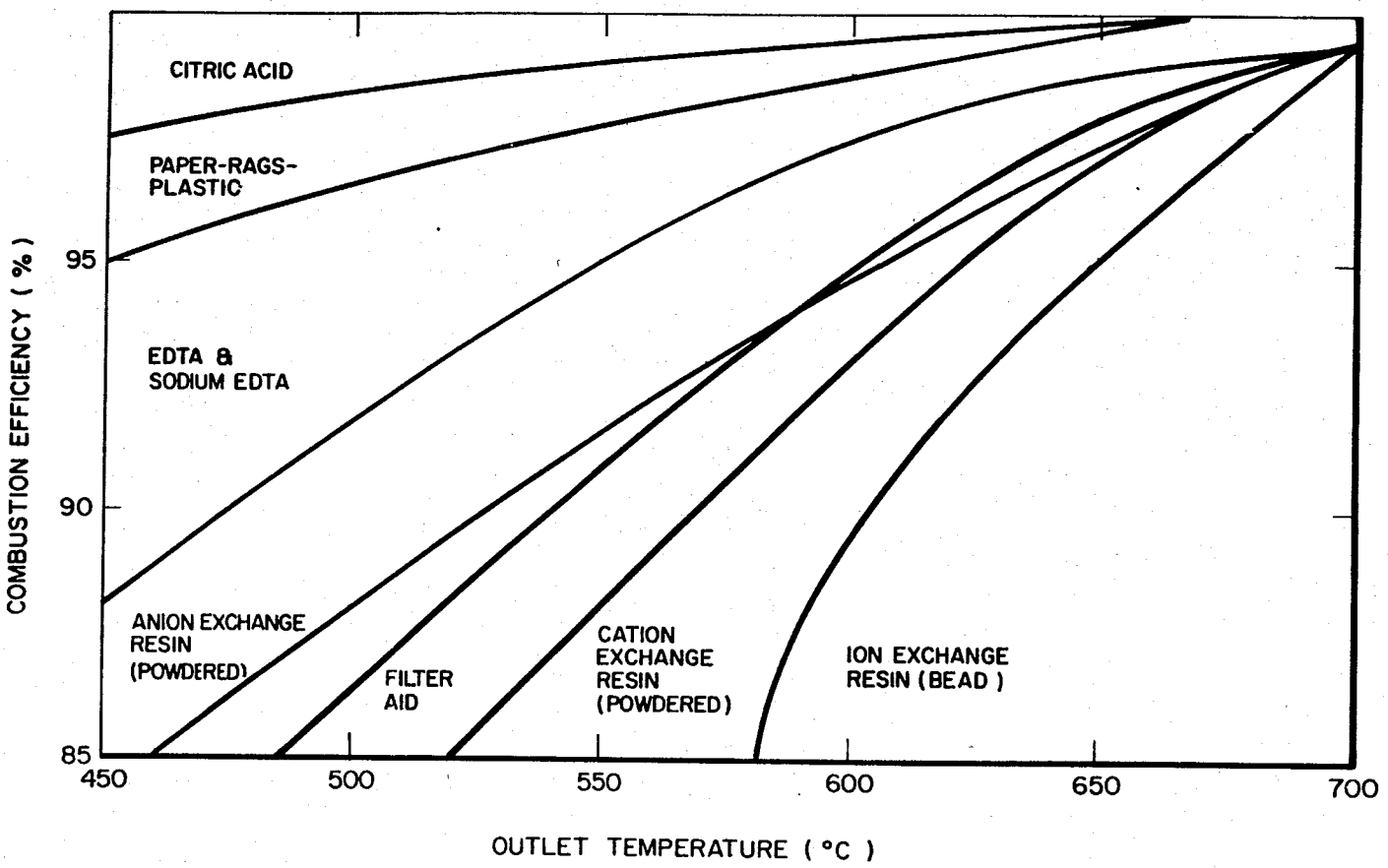

FIG. 2 shows an apparatus which is suitable for carrying out the process of the present invention. A heated gas spray converter 100 is equipped with thermal insulation 102, an atomizer 104 with liquid and air inlets 106 and 108, respectively, and an inlet pipe 110 communicating with a burner 112. A pipe 114 at the bottom of heated gas spray converter 100 leads to a cyclone 116 equipped with a solid product receiver 118 and an outlet pipe 120, which leads through a valve 122, an air dilution inlet 124, and an outlet pipe 126 to a blower 128 and thence to a vent system 130 which may include a prefilter and HLPA filter system, particularly where radioactive materials are being processed.

The provision of a cyclone in the embodiment of FIG. 2 is of particular use for recycling partially converted bead ion exchange resins, since the larger particles of unconverted ion exchange resin can be separated in the cyclone and recycled for a second pass through the heated gas spray converter in order to complete the conversion as described above.

The invention may be better understood by reference to the following examples which are intended to be illustrative of the process of the present invention and not in any way limitative thereof.

EXAMPLE 1

A nonradioactive simulated high-level liquid waste containing a high proportion of nitrate having the composition shown in Table 1 was calcined in a heated gas spray converter similar to that shown in FIG. 2.

TABLE 1

Composition of Simulated High-Level Liquid Waste

| Element | Content (Moles/Liter) | Molecular Form |
|---|---|---|
| H | 1.83 | $HNO_3$ |
| Na | 0.82 (0.97)* | $NaNO_3$ |
| K | 0.025 (0.039)* | $KNO_3$ |
| Sr | 0.017 | $Sr(NO_3)_2$ |
| Ba | 0.019 | $Ba(NO_3)_2$ |
| La | 0.12 | $La(NO_3)_3.6H_2O$ |
| Mo | 0.075 | $Na_2MoO_4.2H_2O$ |
| Te | 0.0071 | $K_2TeO_3.2H_2O$ |
| Fe | 0.074 | $Fe(NO_3)_3.9H_2O$ |
| Ni | 0.023 | $Ni(NO_3)_2.6H_2O$ |
| Cr | 0.0074 | $Cr(NO_3)_3.9H_2O$ |
| Co | 0.0068 | $Co(NO_3)_2.6H_2O$ |

*Total molarity of alkali cation including Mo and Te compounds

The converter was a sprav drver which had been modified by installing 6-inch-thick insulation and trace heaters on the exterior walls of the spray dryer. With the trace heaters turned on, the initial converter temperature was 300° C. Hot gas from a burner using natural gas and an excess of air was passed through the heated gas spray converter for a period of 4 hours to heat the converter from the initial 300° C. temperature to a 700° to 900° C. operating temperature. A two-fluid spray nozzle was installed into the converter and compressed air was used as the atomizing gas. Flow through the atomizer was begun prior to the converter heat-up. The blower was actuated and the burner ignited. Distilled water was then fed to the nozzle through the liquid line. As the heated converter approached operating temperature, the water and air flow to the nozzle was adjusted to the desired operating parameters. The converter was then operated for ½ hour before the simulated waste was injected into the system. After the desired amount of simulated liquid waste was fed to the system, the liquid feed was again switched to distilled water. A summary of the results obtained in several tests is given in Table 2.

TABLE 2

Spray Calcination of Simulated High-Level Liquid Waste

| Test No. | Temperature (°C.) Converter Gas Inlet | Converter Gas Outlet | Converter Walls Cylindrical | Converter Walls Conical | Cyclone Outlet | Product Composition (%) Volatile* | Water | Nitrate | Feed Rate (l/hr) |
|---|---|---|---|---|---|---|---|---|---|
| 1 | 874 | 749 | 764 | 742 | 582 | 3.7 | 0.58 | 0.1 | 2.91 |
| 2 | 846 | 685 | 699 | 679 | 552 | 4.2 | 0.59 | 1.2 | 2.70 |
| 3 | 895 | 675 | 685 | 665 | 540 | 4.8 | 0.36 | 0.2 | 5.83 |
| 4 | 757 | 640 | 595 | 585 | 489 | 10.5 | 0.59 | 8.7 | 2.68 |
| 5 | 714 | 590 | 608 | 589 | 482 | 13.2 | 0.74 | 14.6 | 6.72 |
| 6 | 815 | 695 | 709 | 680 | 547 | 4.3 | 0.57 | 0.9 | 6.90 |
| 7 | 427 | 337 | 404 | 280 | 70 | 42.3 | 0.48 | 53.0 | 0.49 |

*weight loss at 800° C. after 10 hours.

These data show that a calcine was obtained with a concentration of less than about 2 wt % nitrate at outlet temperatures of about 675° C. or higher. Test 7 is included for comparison purposes. In this test, an outlet temperature of only 337° C. was found to be sufficient to decrease the water content of the product to about 0.5%. However, the low outlet temperature resulted in an extremely high nitrate content. This test was conducted using electric wall heating only, without any hot gas being introduced into the system from the natural gas burner and shows that at temperatures below the prescribed temperatures, the wastes are merely dried without effecting the desired calcination.

EXAMPLE 2

The heated gas spray converter described in Example 1 was utilized in the destruction of powdered ion exchange resins in the form of aqueous slurries. The conditions and results are shown in Table 3. In Test 8, the resin remaining after conversion had a char coating. In Tests 9 and 10 the resins were completely destroyed. It can be seen from these results that an outlet temperature of at least about 600° C. is requi2red to completely destroy ion exchange resins. It can also be seen that aqueous slurries of ion exchange resins are destroyed by the conversion process of the present invention.

TABLE 3

Destruction of Ion Exchange Resins

| Test No. | Ion Exchange Resin | Mesh Size | Slurry Conc. (Kg/l) | Slurry Feed Rate (Kg/hr) | Converter Temperature (°C.) Inlet | Outlet | Wall | Destruction (%) |
|---|---|---|---|---|---|---|---|---|
| 8 | DOWEX-1X-8 | 100 | 0.11 | 1.4 | 860 | 545 | 525 | ~80 |
| 9 | CGC-241 | 100 | 0.09 | 4.2 | 840 | 600 | 635 | ~100 |
| 10 | CGC-241 | 100 | 0.09 | 6.0 | 840 | 600 | 665 | ~100 |

EXAMPLE 3

The procedure of Example 2 was followed using a 20 wt % PCH POWDEX cation exchange resin slurry in water and 10 wt % $Na_2CO_3$ in the feed to the spray converter. In all instances the destruction of cation exchange resin was essentially complete, The results are shown in Table 4.

TABLE 4

Sulfur Dioxide Control with $Na_2CO_3$ in Feed During Spray Conversion of Cation Resins

| Test No. | Temperature (°C.) Inlet | Outlet | Wall | Percent $SO_2$ Absorbed |
|---|---|---|---|---|
| 11 | 830 | 680 | 670 | 91 |
| 12 | 850 | 695 | 680 | 94 |
| 13 | 875 | 690 | 680 | 98 |
| 14 | 875 | 700 | 690 | 98 |
| 15 | 875 | 700 | 685 | 98 |

From these results it can be seen that it is possible to remove up to 98% of the $SO_2$ produced from cation exchange resin destruction in the heated gas spray converter by introducing an alkali with the cation exchange resin slurry.

EXAMPLE 4

The heat gas spray converter described in Example 1 was utilized in the destruction of an 8.25 wt % citric acid solution. The conversion conditions and results are shown in Table 5.

TABLE 5

Spray Conversion of Citric Acid Solutions

| Test No. | Temperature (°C.) Inlet | Outlet | Feed Rate (kg/hr) | Percent Destruction |
|---|---|---|---|---|
| 16 | 680 | 595 | 13.0 | 99.5 |
| 17 | 680 | 590 | 13.0 | 99.5 |
| 18 | 600 | 500 | 6.4 | 98.9 |
| 19 | 615 | 510 | 6.4 | 98.9 |
| 20 | 490 | 410 | 7.6 | 95.5 |
| 21 | 495 | 415 | 7.8 | 96.7 |
| 22 | 365 | 305 | 8.1 | 88.4 |
| 23 | 370 | 305 | 7.7 | 86.2 |
| 24 | 875 | 685 | — | 99.8 |
| 25 | 860 | 690 | — | 99.8 |

From these data it can be seen that outlet temperatures of about 500° C. are effective to destroy over 98% of the citric acid solution.

EXAMPLE 5

The heated gas spray converter described in Example 1 was utilized in the destruction of EDTA complexing agents. Mixtures of 10 wt % ethylenedinitrilo tetraacetic acid and sodium ethylenedinitrilo tetraacetate were fed as slurries. The results obtained are shown in Table 6.

TABLE 6

Spray Conversion of EDTA* Slurries

| Test No. | Temperature (°C.) Inlet | Outlet | Feed Rate (kg/hr) | Percent Destruction |
|---|---|---|---|---|
| 26 | 685 | 585 | 8.1 | 94.6 |
| 27 | 675 | 580 | 6.5 | 95.6 |
| 28 | 605 | 495 | 8.0 | 95.7 |
| 29 | 610 | 495 | 8.0 | 94.6 |
| 30 | 495 | 415 | 7.4 | 84.6 |
| 31 | 495 | 415 | 8.4 | 85.8 |
| 32 | 365 | 305 | 7.6 | 95.0 |
| 33 | 350 | 295 | 6.8 | 93.0 |
| 34 | 850 | 675 | — | 98.6 |

*EDTA = Ethylenedinitrilo tetraacetic acid $(HOCOCH_2)_2NCH_2CH_2N(CH_2COOH)_2$

From these data it can be seen that outlet temperatures of about 500° C. are effective to destroy about 95% of the EDTA.

EXAMPLE 6

The heated gas spray converter described in Example 1 was utilized in the destruction of bead ion exchange resins to demonstrate the effectiveness of the process of the present invention in reducing the volume of wet solids. Ecodyne Gravex GR-2 cation exchange resin (0.09% ash) and Ecodyne Gravex GR-1 anion exchange resin, (0.02% ash), 12×60 mesh, were introduced into the converter by means of a pneumatic conveying nozzle equipped with a dispersal plate. The treatment conditions and results are shown in Table 7.

TABLE 7

Spray Conversion of Bead Cation and Anion Exchange Resins

| Test No. | Percent Water | Temperature (°C.) Inlet | Outlet | Wall | Feed Rate (lb/hr) | Percent Destruction |
|---|---|---|---|---|---|---|
| Cation | | | | | | |
| 35 | 75 | 835 | 695 | 685 | 8.2 | 95 |
| 36 | 50 | 805 | 725 | 720 | 9.6 | 0.24 |
| Anion | | | | | | |
| 37 | 66 | 800 | 760 | 730 | 4.3 | 99.1 |
| 38 | 66 | 730 | 730 | 725 | 8.6 | 98.1 |
| 39 | 66 | 745 | 720 | 720 | 7.5 | 99.4 |

From these data it can be seen that destruction of about 93% of the bead cation exchange resin and about 99% of the bead anion exchange resin was realized at outlet temperatures of about 700° C.

The heated gas spray converter described in Examples 1 and 6 was utilized in the destruction of various other dry solids of the type produced in a nuclear

EXAMPLE 7 power plant. The conditions of treatment and results are shown in Table 8. In the case of sawdust, water was deliberately added to make the sawdust more difficult to burn (Tests 43, 44, 45 and 46). The filter aid used was Ecodex 1245 filter aid (Test 50).

Solid Ecodyne Gravex 2 bead cation exchange resin conversion residue from a previous test with an outlet temperature of <600° C. and only 75% destruction was treated a second time in the heated gas spray converter to determine the effect of a second pass through the converter with the results shown in Test 51.

TABLE 8

Destruction of High Ash Paper, Wet Sawdust, and Plastic

| Test No. | Material | Temperature (°C.) Inlet | Outlet | Wall | Destruction (wt %) |
|---|---|---|---|---|---|
| 40 | Paper | 640 | 635 | 625 | 92.8 |
| 41 | Paper | 550 | 515 | 525 | 85.8 |
| 42 | Paper | 470 | 445 | 460 | 58.2 |
| 43 | Wet sawdust | 830 | 800 | 750 | 99.2 |
| 44 | Wet sawdust | 725 | 730 | 740 | 99.2 |
| 45 | Wet sawdust | 710 | 715 | 720 | 98.0 |
| 46 | Wet sawdust | 710 | 700 | 700 | 98.9 |
| 47 | Cardboard | 540 | 510 | 540 | 93.2 |
| 48 | PVC solid | 550 | 540 | 550 | 95.2 |
| 49 | Polyethylene solid | 555 | 540 | 550 | 73.3 |
| 50 | Mixture of 50% high ash paper and 50% filter aid | 550 | 545 | 540 | 88.9 |
| 51 | Cation resin ash recycle | 720 | 730 | 660 | 96.1 |

From the above data it can be seen that the destruction of various solid wastes is substantially complete at outlet temperatures of about 500° to 800° C. It can also be seen that practically complete destruction of difficult to destroy ion exchange resins can be realized by recycling the residue from a previous conversion through the heated gas spray converter.

Other waste materials which can be converted in accordance with the process of the present invention include boric acid and alkali metal borate solutions, alkali metal sulfate solutions and various aqueous decontamination wastes.

It will, of course, be realized that various modifications can be made to the design and operation of the process of this invention without departing from the spirit thereof. For example, waste materials other than those specifically exemplified herein can be thermally converted according to the process of this invention. In addition, other means can be used to separate the gases and solid products of the process and other ways of treating the gaseous and solid products following separation can be used, if desired. Thus, while the principle, preferred design and mode of operation of the invention have been explained and what is now considered to represent its best embodiment has been illustrated and described, it should be understood that, within the scope of the appended claims, the invention can be practiced otherwise than as specifically illustrated and described.

I claim:

1. A process for the thermal conversion of a radioactive waste material which comprises the sequential steps of:

introducing said radioactive waste material in the form of a finely atomized spray into the top of a spray dryer zone heated, by means of a hot gas produced externally of said zone on combustion of a fuel and air and introduced into the top of said zone, to a temperature of about 500° to 1000° C. to convert said radioactive waste material, by contact with said hot gas, into a mixture of products including a non-radioactive gas comprising gaseous $H_2O$, $CO_2$ and nitrogen and a radioactive inorganic ash;

removing said mixture of products from the bottom of said zone, and separating said radioactive inorganic ash from said mixture of products, the ratio of the volume of said radioactive waste material to the volume of said ash being in the range of about 7:1 to 70:1.

2. A process according to claim 1 wherein said waste contains sodium nitrate and the nitrate content of said radioactive ash is reduced by at least about 98% from the nitrate content of said waste.

3. A process according to claim 1 wherein said zone is heated to a temperature in the range of about 600° to 850° C.

4. A process according to claim 1 wherein the temperature within said zone is not permitted to fall below about 600° C.

5. A process according to claim 1 wherein said hot gas is produced by combustion of a fuel in an excess of an oxidizing gas.

6. A process according to claim 1 wherein said hot gas comprises a mixture of oxygen, nitrogen and the oxidation products of natural gas.

7. A process according to claim 1 wherein said radioactive waste material comprises a complexing aid selected from the group consisting of citric acid, EDTA and a sodium salt of EDTA.

* * * * *